United States Patent [19]

Koehler et al.

[11] 3,937,027

[45] Feb. 10, 1976

[54] METHOD AND APPARATUS FOR TRANSPORTING AND LAUNCHING AN OFFSHORE TOWER

[75] Inventors: Albert M. Koehler; Stanley J. Hruska, both of Houston, Tex.

[73] Assignee: Brown and Root, Inc., Houston, Tex.

[22] Filed: Jan. 22, 1975

[21] Appl. No.: 542,948

[52] U.S. Cl. ..... 61/46.5; 214/12

[51] Int. Cl.[2] ..... B63B 27/00; E02B 17/02

[58] Field of Search ..... 61/46.5, 67; 214/12, 146.5; 114/43.5

[56] References Cited

UNITED STATES PATENTS

| | | | |
|---|---|---|---|
| 1,514,769 | 11/1924 | Johnston et al. | 214/146.5 |
| 2,370,431 | 2/1945 | Ward et al. | 61/67 |
| 2,422,168 | 6/1947 | Kirby | 61/46.5 |
| 2,754,017 | 7/1956 | Hart et al. | 61/67 X |
| 3,054,267 | 9/1962 | Alcorn et al. | 61/46.5 |
| 3,347,052 | 10/1967 | Steitle et al. | 61/46.5 |

*Primary Examiner*—Jacob Shapiro
*Attorney, Agent, or Firm*—Kenway & Jenney

[57] ABSTRACT

The invention affords a method and apparatus for transporting and erecting an offshore tower. The invention entails a barge which buoyantly supports the tower as it is conveyed to a desired offshore location. Supporting means connected to the barge and sliding means connected to the tower slidingly interconnect the tower and the barge. Suitable rotating means operably associated with the barge serves to rotate the barge about the longitudinal axis thereof to lower one side and thus statically, laterally incline the supporting means and the sliding means relative to the surface of the surrounding water. This occurs once the barge and tower reach the desired offshore location. Translating means operably associated with the barge are afforded for the purpose of moving the tower down the resulting incline, off the lowered side of the barge, and into the surrounding water. In the course of this downward movement, the tower and sliding means move in sliding relation along the supporting means.

In transporting and erecting an offshore tower, the tower is first supported on the barge and floated to the desired offshore location. Thereupon, the barge is rotated about the longitudinal axis thereof to lower one side and statically, laterally incline the surfaces upon which the tower rests, relative to the surface of the surrounding body of water. Thereafter the tower is translated down the incline off the lowered side of the barge and into the water, free of the barge. The intended lower portion of the tower is next submerged to turn the tower upright in the body of water. Next the base of the tower is located at the desired location on the floor of the body of water.

9 Claims, 11 Drawing Figures

FIG. 1
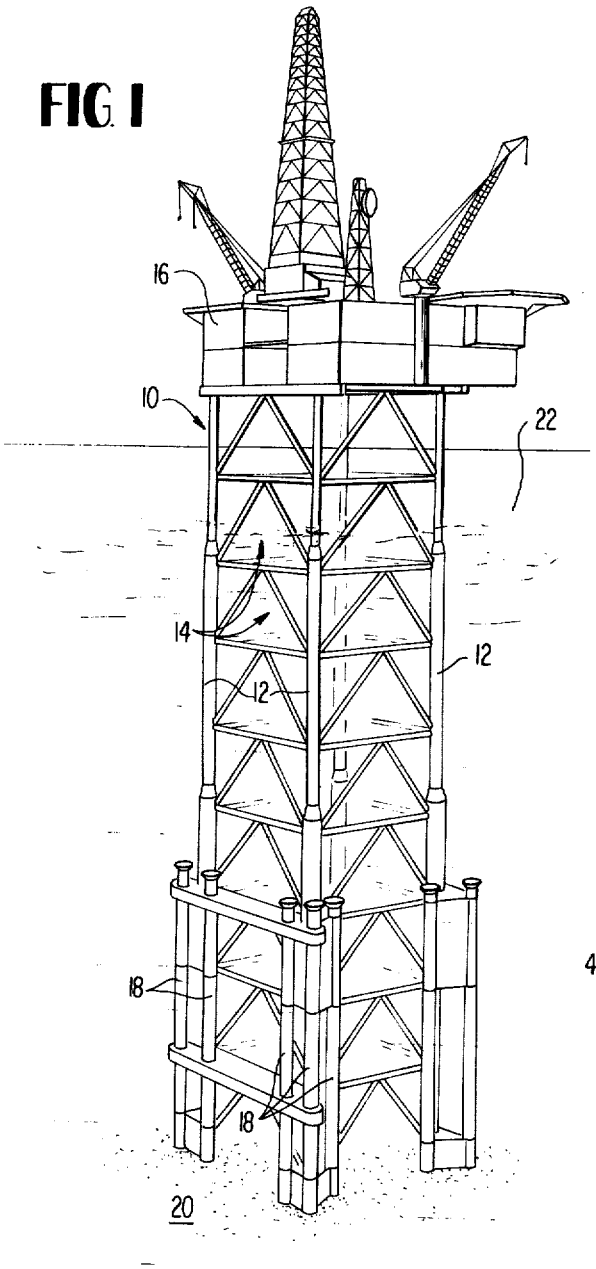
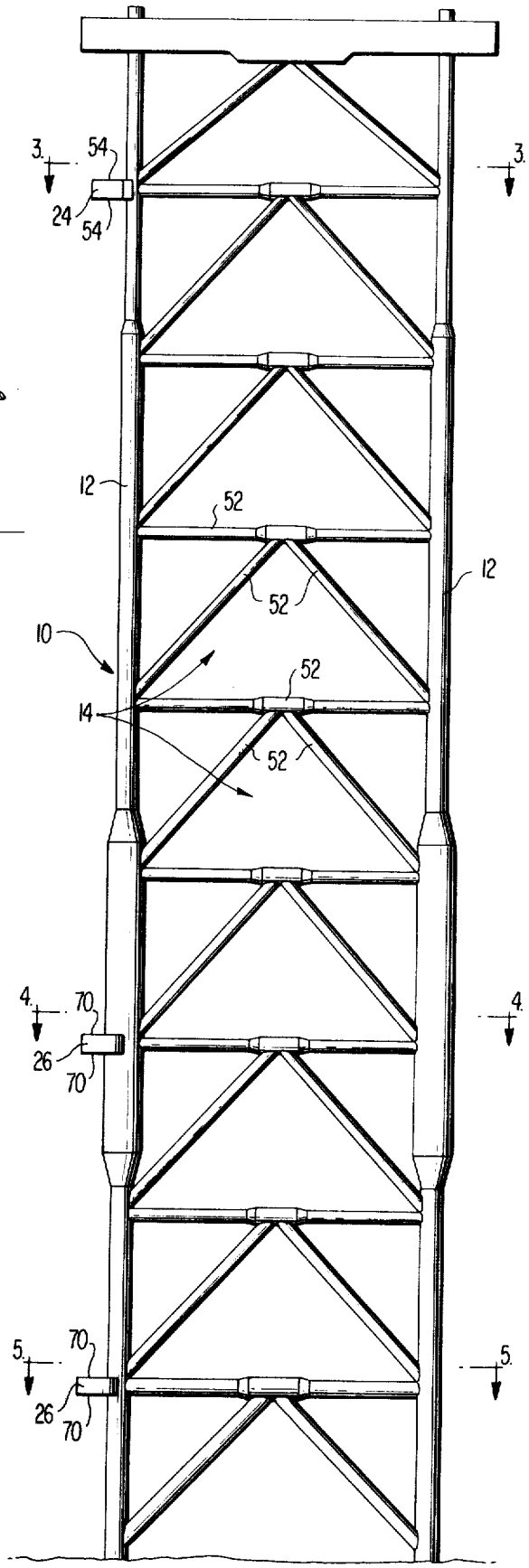
FIG. 2

METHOD AND APPARATUS FOR TRANSPORTING AND LAUNCHING AN OFFSHORE TOWER

BACKGROUND OF THE INVENTION

The invention relates generally to a method and apparatus for transporting and erecting a tower at a desired site within a body of water. More particularly, the invention relates to a method and apparatus for rapidly and conveniently transporting, launching, and positioning the tower and for recovering for reuse the portion of the invention employed in transporting the tower.

In the past, offshore towers have been employed advantageously in a number of different marine situations. For instance, offshore towers have been employed as supports for radar or sonar stations, light beacons, and various types of laboratories. Furthermore, offshore towers have frequently been employed in the exploration for oil in an offshore environment.

The use of offshore towers in the exploration for oil has received increasing emphasis as supplies of petroleum indigenous to the major industrial countries have diminished and as countries having significant surplus reserves have become more nationalistic. In the past, the exploration for oil in offshore environments has been conducted in locations having relatively shallow water. Areas of this type which are productive of oil and gas exist, for instance, along the shores of the Gulf of Mexico.

Recently however, dramatic increases in the price of oil have made exploration for oil in the geological strata underlying very deep areas of the oceans economically practical. Indeed, exploration has been conducted to date in water approaching a thousand or more feet in depth. Oil fields submerged in water of this depth may be found for instance along the Pacific Continental Shelf of the United States, certain Arctic regions, and in the North Sea. Exploration of these and other areas having similarly deep water is continuing and, indeed, exploration is being pressed into ever deeper areas of the oceans.

In order to exploit oil fields existing beneath such substantial depths of water, towers formerly deemed quite reliable and effective have undergone drastic redesign to accommodate anticipated prolonged stress of rather high levels, as well as stresses introduced by recurrent natural phenomena. The redesign has resulted in towers enormous in both size and weight. The enormous size and weight of the towers has precipitated great difficulties in the construction, transportation, and erection thereof. The transportation and erection of the towers pose the most difficult problems since these two operations must be conducted on the high seas fully exposed to the effects of what is often a very hostile environment. This is particularly the case with towers which must be erected in areas such as the North Sea.

In dealing with problems regarding the transportation and erection of offshore towers attention has been focused on the concept of a buoyant support which is structurally independent of the offshore tower. Typically, once the tower and buoyant structure reach the desired offshore location, the tower and buoyant structure are disconnected, whereupon the buoyant structure can be employed in connection with other towers. Such an arrangement reduces the weight and surface area of the tower significantly so that not only is the cost of the tower itself reduced, but the tower is rendered less vulnerable to hydrodynamic and seismic forces.

One method and apparatus for transporting and erecting an offshore tower which embraces the concept described in the foregoing paragraph entails the attachment of one or more pontoons to the exterior of the tower. The tower is thereupon floated to a desired offshore location resting upon the pontoons. Once the offshore location is reached, the tower can be erected by releasing the pontoons in a manner causing the offshore tower to settle into an upright posture on the floor of the body of water. This approach has been found to be undesirable in some cases for a number of reasons. For instance, due to the enormous forces of buoyancy exerted in supporting the tower, the pontoons may be subject to sudden, violent movement when released. In addition, if the pontoons are employed to lower the tower into place on the floor of the body of water the center of gravity of the combined tower and pontoon may shift as the pontoons are ballasted. As a result, placement of the tower may be rendered more difficult.

Another method and apparatus for transporting and erecting an offshore tower in which the buoyant support is unitary and can be recovered and reused entails the use of a buoyant structure which is generally rectangular in configuration. The buoyant structure includes two iinterconnected lower pontoons and a pair of upper pontoons connected thereto by vertically extending, buoyant columns. An offshore tower to be transported and erected through the use of this buoyant structure is surrounded by and releasably connected to the upper and lower pontoons and the interconnecting buoyant columns. The tower and buoyant structure are turned upright in the water and separated once the base of the tower is resting on the bottom of the body of water.

Theoretically, such an arrangement has some appeal. However, in practice, significant improvement may be necessary. The structure is relatively complex and requires considerable amounts of materials for construction. The buoyant structure is thus relatively costly. Furthermore, the size and configuration of the buoyant structure may render the combined buoyant support and tower relatively unseaworthy. Furthermore, in light of the manner in which the buoyant structure surrounds the tower, the buoyant structure cannot be rapidly removed. Thus, the entire structure may be subjected to considerable buffeting by winds and heavy seas. Somewhat related to the foregoing problem is that caused by the tendency of the buoyant structure to be hydrodynamically driven into the tower once the connection therebetween is released. Also, the movement of the combined tower and buoyant structure in the course of the erection of the tower may be relatively erratic and sudden, and may for this reason be less suitable.

It would be quite helpful considering the preceding remarks, if a method and apparatus could be provided wherein the buoyant structure requires fewer materials so that the cost may be reduced and the seaworthiness of the structure increased. It would be also desirable if the buoyant structure could be quickly removed from the vicinity of the tower so that the tower is less subject to buffeting and there is less danger of any impacting of the tower by the buoyant structure. It would also be highly useful if a method and apparatus could be provided wherein the combined buoyant support and tower could be moved gently and predictably as the tower is being erected.

Yet another method and apparatus previously used in transporting and erecting an offshore tower is comprised of a pair of pivotally connected barges. As the tower is being conveyed to the desired offshore location, the barges are oriented relative to one another so as to fall in a single plane. One of these barges is considerably larger than the second and can be employed to support the tower as the barges are jackknifed relative to one another to lower the tower to the floor of the body of water. The larger of the two barges remains in a floating condition on the surface of the body of water. Thus, the placement of the tower is dependent upon buoyant structural elements located on the surface of the body of water. This restricts the usefulness of the arrangement described in the preceding to relatively shallow water and towers of relatively small size. It would thus be highly desirable if a method and apparatus could be provided in which the placement of the tower is independent of structural elements located on the surface of the body of water and which can be used to handle large towers in relatively deep water.

A further approach to the problem of transporting and erecting an offshore tower contemplates the use of a conventional barge carrying an inclined skidway built up from the deck and sloping downwardly toward the stern of the barge. Carried atop the inclined skidway is an offshore tower having a central, buoyant column nested among the legs thereof. The offshore tower is transported atop the skidway and once the desired offshore location is reached is disconnected from the barge and moved down the skidway in response to forces exerted by an auxiliary vessel. The auxiliary vessel ultimately pulls the offshore tower into the water where the tower assumes a horizontally floating posture. Thereafter, the central bouyant column is ballasted to turn the tower upright and lower it to the floor of the body of water.

Though such an arrangement may be suitable in certain circumstances, a number of serious structural problems may be involved. For instance, the use of an inclined skidway requires the fabrication of an additional structural element as an integral part of the bouyant support. Furthermore, the skidway must be of a highly durable character, capable of sustaining towers of enormous weight. This sort of structure necessarily requires considerable amounts of materials and labor. Additionally, the structure of the inclined skidway may render the barge somewhat top heavy and thus may diminish the degree of seaworthiness of the combined barge and offshore tower. The requirement of an inclined skidway may also render the barge less flexible in use, as towers of different configuration may require skidways of different configuration. Additionally, and quite importantly is the problem caused by the required length of the skidway. Because the skidway extends along most of the length of the tower, considerable resistance may be offered against the movement of the tower down the skidway and into the water.

Other problems reside in the control of the movement of the tower as it is launched. It is important that the movement of the offshore tower be carefully controlled as the tower enters the water as well as when it is being turned upright. The movement of the offshore tower down the skidway, into the water off the stern of the barge, takes place with the tower sliding in a direction roughly parallel to the longitudinal axis thereof.

Since only a small portion of the tower, viz. the base, enters the water first, undesirable movement of the tower may occur. There may not be sufficient initial positive control of the movement of the tower for safe and reliable erection thereof on the floor of the body of water.

Perhaps the most significant problem of the approach presented above resides in the fact that the launching of an offshore tower end first from a barge by sliding the tower down an inclined skidway may greatly alter the posture of the barge in the water. The stern of the barge may be forced into an essentially submerged condition. Once the tower clears the barge however, the barge may undergo rapid, violent movement in response to buoyant forces exerted on the stern or other areas of the barge undergoing inordinant amount of deflection.

Considering the foregoing remarks, it would be highly desirable if a novel method and apparatus for transporting and erecting an offshore tower could be provided in which no additional structural elements are required for the purposes of launching the tower and in which the bouyant structure employed to transport the tower is readily adaptable to various structures of different configuration. It would be desirable as well if resistance to the launching of the tower could be reduced or substantially eliminated. It would also be highly desirable if in launching the tower the movement thereof could be positively controlled to within relatively close tolerances. It would also be desirable to avoid violent movement of the bouyant support.

Other methods and apparatus for transporting and erecting a tower employed in the prior art also do not afford sufficient control over the movement of the tower. Control of the movement of the tower involves two distinct aspects. The first has to do with the particular manner in which the tower is first introduced into the water. In many instances in the prior art, the tower is introduced into the water in such a way that the tower may be subjected to undesirable movement. Clearly, if such movements cannot be adequately controlled, erection of the tower may be greatly hampered. A second aspect of the problem resides in the control of the tower once the tower is in the water and as it is being turned upright prior to placement on the floor of the body of water. As the tower is being turned upright, the tower may be vulnerable to rolling. This mode of uncontrolled movement also can render placement of the tower difficult. It would therefore be highly desirable if a novel method and apparatus could be provided in which the movement of the offshore tower can be controlled to an extent sufficient to prevent the tendency of the tower to pitch or roll from interfering with the placement of the tower.

The problems suggested in the preceding, while not exhaustive, are among many which tend to reduce the effectiveness and desirability of methods and apparatus of the prior art for transporting and erecting offshore towers. Other noteworthy problems may also exist; however, those presented in the discussion above should be sufficient to demonstrate that such methods and apparatus appearing in the prior art have not been entirely satisfactory.

OBJECTS AND SUMMARY OF THE PREFERRED FORMS OF THE INVENTION

In light of the foregoing, it is a general object of the invention to provide a novel method and apparatus for transporting and erecting an offshore tower intended to obviate or minimize problems of the type noted.

It is a particular object of the invention to provide a novel method and apparatus for transporting and erecting an offshore tower wherein the buoyant support employed to carry or manipulate the tower is of such a character that it undergoes little or no violent movement upon disconnection from the tower.

Another object of the invention is to provide an innovative method and apparatus for transporting and erecting an offshore tower wherein the buoyant structure employed to transport the tower can be shed upon reaching the desired offshore location to reduce buffeting of the tower and possible impacting of the structures together.

Still another object of the invention is to provide a novel method and apparatus wherein the bouyant structure employed to convey the offshore tower to the desired offshore location can be readily retrieved and reused to convey another offshore tower to a different location.

Yet still another object of the invention is to provide a novel method and apparatus wherein the offshore tower, upon being launched, can be turned upright and placed on the floor of the body of water with either only a minimal or only a predictable shift in the location of the center of gravity thereof so that better control can be maintained over the placement of the tower.

A further object of the invention is to provide an innovative method and apparatus for transporting and erecting an offshore tower wherein the mode of entry of the tower into the water is such that the tendency of the tower to roll can be controlled within sufficiently close tolerances as to ensure safe and reliable placement of the tower on the floor of the body of water.

A still further object of the invention is to provide a novel method and apparatus for transporting and erecting an offshore tower wherein the buoyant support afforded the tower during transportation to the desired offshore location is removed in a manner diminishing the vulnerability of the tower to uncontrolled movement.

Yet still a further object of the invention is to provide an innovative method and apparatus for transporting and erecting an offshore tower in which the placement of the tower on the floor of the body of water is independent of structural elements floating on the surface and which is amenable to the convenient placement of large towers in deep water.

Yet another object of the invention is to provide a novel method and apparatus for transporting and erecting an offshore tower wherein extraneous structural elements associated with the buoyant structure transporting the tower are obviated.

Yet still another object of the invention is to provide an innovative method and apparatus for transporting and erecting an offshore tower in which the resistance offered by the buoyant support to the launching of the tower is minimized.

A novel apparatus according to the invention is preferably comprised of a barge which buoyantly supports the tower as the tower is conveyed from an area such as a fabrication yard, to a desired offshore location. Suitable support means are disposed on the barge for the purpose of supporting the tower as it rests thereon. In the course of construction, sliding means of a suitable nature are connected to the tower so as to slidingly interconnect the tower and the supporting means disposed on the barge. Operably associated with the barge is suitable rotating means which serves to rotate the barge about a longitudinal axis to thus lower a side of the barge and statically, laterally incline the supporting means of the barge and the sliding means of the tower relative to the surface of the surrounding body of water. This occurs once the tower and the barge have reached the desired offshore location. The tower is moved down the incline of the supporting means and off the lowered side of the barge, into the surrounding water by appropriate translating means operably associated with the barge. As the tower moves from the barge into the water, the tower and the sliding means together move in sliding relation along the supporting means connected to the barge.

The method of the invention contemplates a number of discrete steps, the first of which is the supporting of the tower on the barge. The tower and the barge are next floated to a desired location whereupon the barge is rotated about a longitudinal axis to lower a side of the barge to thus statically, laterally incline the surfaces thereof upon which the tower rests relative to the surface of the surrounding body of water transversely of the longitudinal axis. The tower is next translated down the incline, off the lowered side of the barge, and into the water so that it is free of the barge. Once the tower is in the water and free of the barge, the lower portion thereof is submerged to turn the tower upright. Thereupon, the base of the tower is located at a desired location on the floor of the body of water.

THE DRAWINGS

Other objects and advantages of the invention will become apparent with reference to the detailed description to follow of a preferred embodiment, wherein like reference numerals have been applied to like elements, and in which;

FIG. 1 is an environmental perspective view of an exemplary offshore tower which may be transported and erected according to the invention;

FIG. 2 is a side view of a tower which may be transported and erected according to the invention, resting on the floor of the body of water and presenting an end view of skids which facilitate the launching of the tower;

DETAILED DESCRIPTION

General Overview

Figure 3:
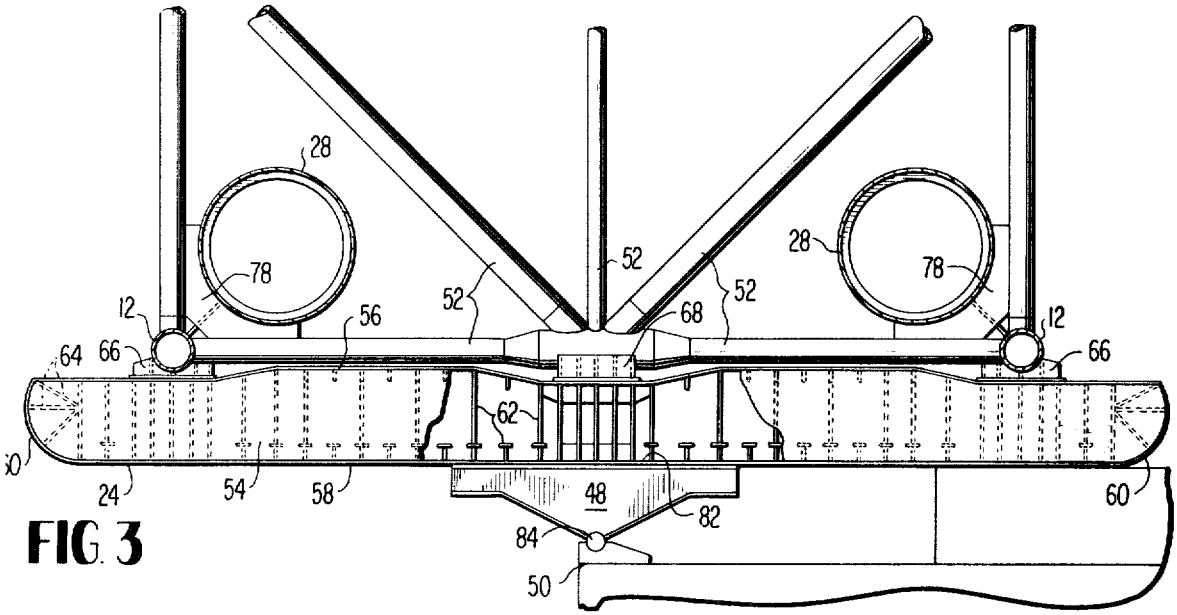
FIG. 3 illustrates a partial, transverse sectional view of the tower taken along the lines 3—3 of FIG. 2, but with the tower resting on a portion of the supporting means of the invention.

Illustrated in FIGS. 1 and 2 is a tower 10 of the general type which may be advantageously transported and erected according to the present invention. As illustrated, the tower generally includes a plurality of legs 12 interconnected by suitable bracing lattice indicated generally at 14. When the tower is fully erected, a suitable superstructure 16 is normally included for the purpose of carrying necessary equipment and conducting the desired activities. Connected to the lower portions of the tower may be a plurality of piling jackets 18 through which piles may be driven to anchor the tower to the floor 20 of the surrounding body of water 22.

Connected to discrete portions of the tower at different vertical level thereof are suitable sliding means which may take the form of skids 24 and 26. As can be appreciated from an examination of FIG. 2, these skids are integrally connected to various structural members of the tower.

Figure 9:
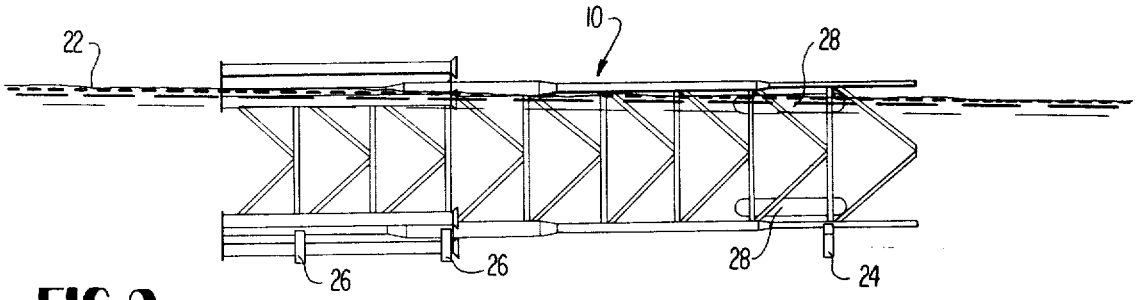
FIG. 9 is a side view of the tower after being launched from the barge moments before the tower is turned upright.
Figure 10:
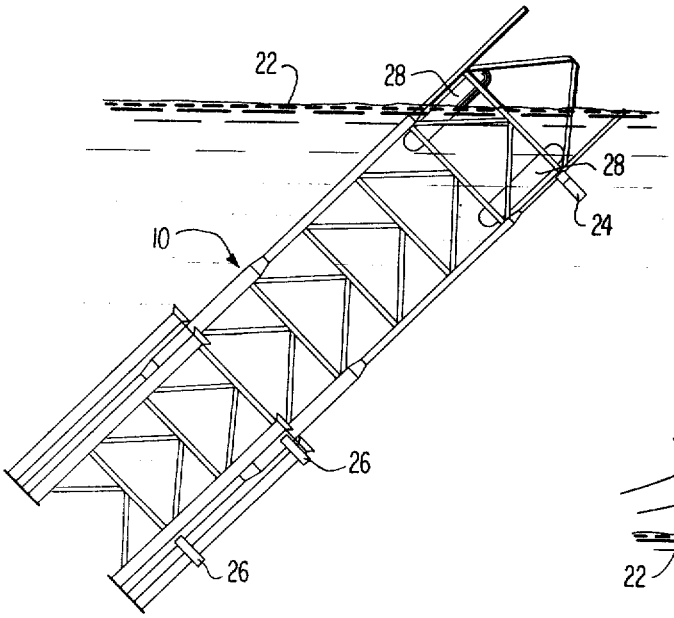
FIG. 10 illustrates a side view of the tower as it is turned upright in the body of water.
Figure 11:
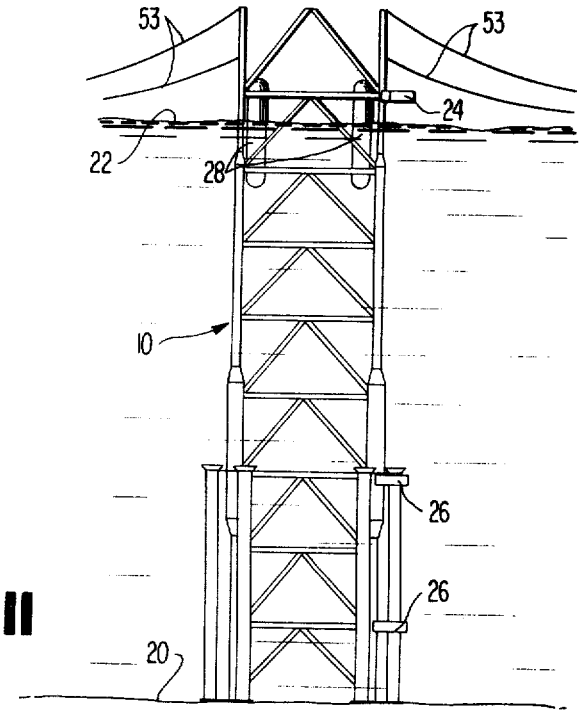
FIG. 11 illustrates a side view of the tower as it is being located on the floor of the body of water.

As illustrated in FIGS. 9, 10, and 11, the tower also carries a quanternary of generally columnar buoyancy tanks 28. These tanks can be seen in transverse section in FIG. 3. The function of these tanks will be described in detail in the course of subsequent discussions.

Figure 6:
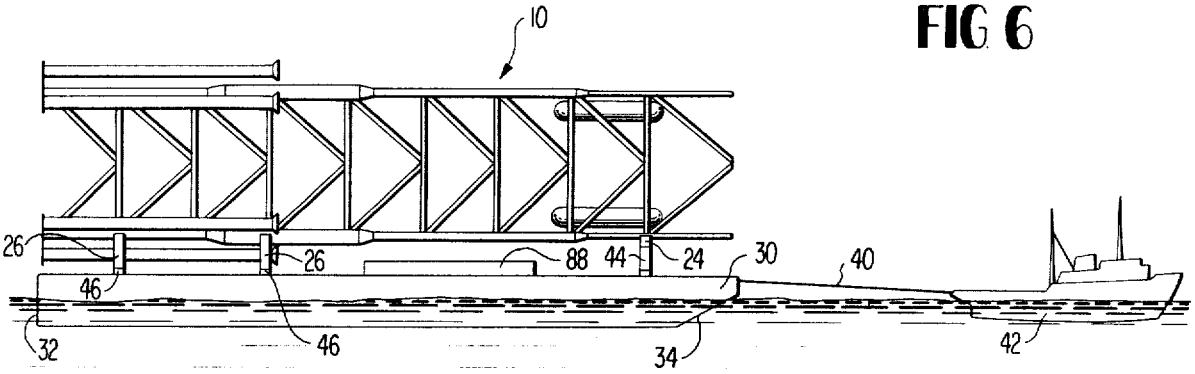
FIG. 6 illustrates a side view of a tower to be transported and erected according to the present invention resting on a barge.
Figure 7:
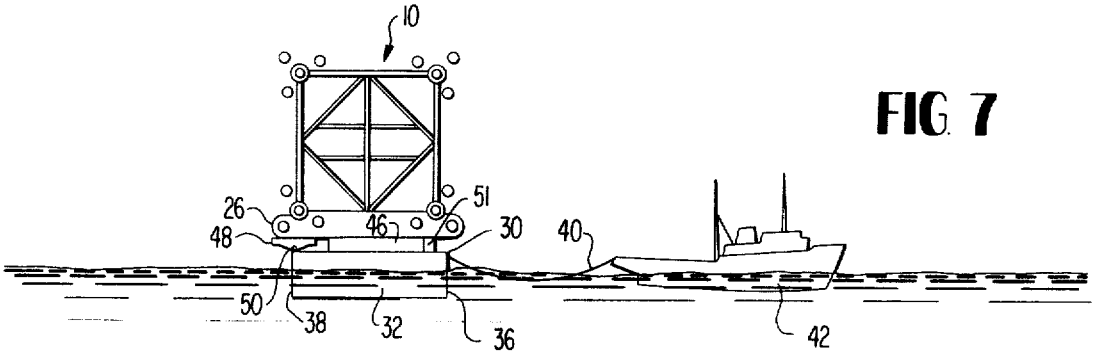
FIG. 7 illustrates an end view of the base of the tower illustrated in FIG. 6 preparatory to the launching of the tower into the body of water.
Figure 8:
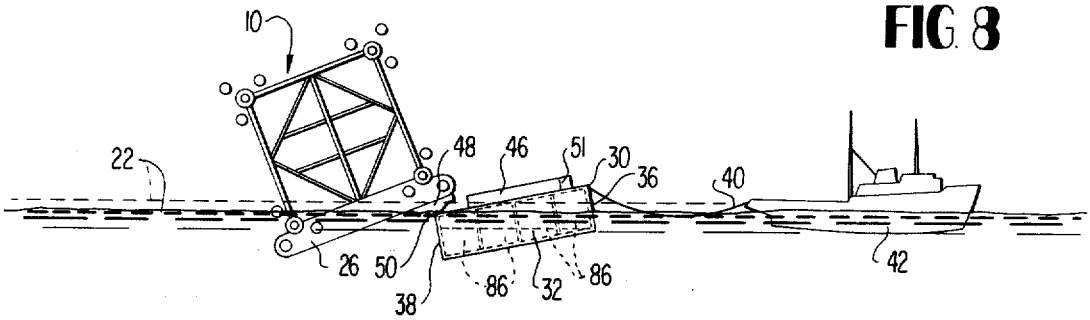
FIG. 8 is an end view of the base of the tower illustrated in FIG. 6 as the barge is rotated and the tower launched.

As illustrated in FIGS. 6, 7, and 8, a barge 30 is employed to buoyantly support the tower 10 as the tower is conveyed to a desired offshore location. The barge assumes a generally rectangular configuration and includes a stern 32, a bow 34, and starboard and port sides 36 and 38 respectively. The barge may be connected through a suitable tether 40 to an auxiliary towing vessel 42. In addition to providing the motive force for transporting the floating barge and tower to a desired offshore location, the auxiliary vessel can perform general anchoring or steadying functions at various stages of the launching of the tower as illustrated in FIGS. 7 and 8.

Disposed on the barge are suitable supporting means for supporting the tower. The supporting means may take the form of suitable skids 44 and 46 having configurations analogous to those of the skids 24 and 26 connected to the tower. The skids 44 and 46 serve to slidingly interconnect the tower and barge through the skids 24 and 26 connected to the tower. This interconnecting relation can perhaps best be appreciated upon examining FIGS. 6 and 7.

Also disposed on the barge 30 is a plurality of pivotable skids 48 which constitute lateral extensions of the skids 44 and 46. These pivotable skids are capable of pivotable movement about at least on generally horizontal axis adjacent an edge 50 of a side of the barge 30.

Operably associated with the barge is a suitable rotating means which is employed to rotate the barge about a longitudinal axis to lower a side and statically, laterally incline the skids 44 and 46 and thus the skids 24 and 26 relative to the surface 22 of the surrounding body of water. This inclination is transverse to the longitudinal axis and is effected once the barge and tower have reached a desired offshore location and it is desired to launch the tower. The effects of the rotating means can best be appreciated from an examination of FIG. 8. The rotating means preferably is comprised of a plurality of buoyancy chambers 86 and appropriate equipment 88 for ballasting the chambers.

Also operably associated with the barge is a suitable translating means 51 which can be employed to move the tower down the incline of the skids 44 and 46, off the side of the barge, and into the surrounding water. Any suitable translating means may be employed and may entail equipment for either merely intiating movement of the tower down the incline, or for providing continuous urging therefor.

The general operation contemplated by the invention can be understood generally from an examination of FIGS. 6 through 11. As can be readily understood from FIG. 6, the tower first must be supported on the barge and floated to a desired offshore location. Once the offshore location is reached, the barge may be ballasted if desired to raise the water line on the barge and move the tower closer to the surface 22 of the body of water. The barge may next be rotated, as illustrated in FIG. 8, about a longitudinal axis to lower one side of the barge and thus statically, laterally incline the surfaces thereof upon which the tower rests, i.e., the skids 44 and 46, relative to the surface 22 of the surrounding body of water. The inclination is lateral in the sense that it is transverse to the longitudinal axis. The tower is next translated down the resulting incline of the skids into the water, free of the barge. In the course of this movement the skids of the tower and barge slide relative to one another.

As the tower moves toward the water, increasing weight is placed on the pivotable skids 48. In some instances, as the lateral center of gravity, i.e., the center of gravity of the tower as viewed from the base (see FIG. 7) projected downwardly, passes the edge of the barge, the weight of the tower will induce pivoting in the pivotable skids. Thus, the inclination of the supportive surfaces of the barge may be increased shortly before the tower enters the body of water. In other instances the pivotable skids will move only after portions of the tower have entered the water. In any case the pivotable skids assist in ensuring that the tower smoothly enters the water and concurrently control the mode of contact between the tower and the edge of the barge.

Once launched, the tower assumes momentarily the posture illustrated in FIG. 9. The launching of the tower into the body of water is followed by the submerging of the intended lower portion of the tower to turn the tower upright. This submerging is accomplished by pivoting the tower about a generally horizontal axis extending through opposite lateral portions thereof. The pivoting can be effected as a consequence of preexisting negative bouyancy of the intended lower end of the tower which allows the lower end to move downwardly while the upper end of the tower continues to be supported principally through the columnar buoyancy tanks. Alternatively, the pivoting can be effected by ballasting to develop negative buoyancy in the lower end of the tower during and/or shortly after launching the tower from the barge.

As the rotation of the tower to submerge the lower portions thereof continues toward the orientation illustrated in FIG. 11, the buoyancy tanks undergo progressive entry into the water. This progressive movement develops buoyancy forces of increasing magnitude. Thus the rotational movement of the tower is slowed and ultimately stopped with the buoyancy tanks suspending the tower above the floor of the body of water.

The base of the tower is next located at a desired site on the floor of the body of water. During this phase of the operation, mooring lines 53 may be employed to steady the tower. The columnar buoyancy tanks 28 or the legs 12 or a combination thereof may at this point be ballasted to gently lower the tower to the floor of the body of water.

The Tower and Skids

As indicated earlier, the tower 10 is essentially comprised of a number of legs which extend, once the tower is erected, from the floor to a position somewhat above the surface of the body of water. The legs of the tower are interconnected by suitable bracing lattice 14 formed by cross members 52. The tower carries suitable sliding means in the form of skids 24 and 26 which operate in slidable relation with suitable supporting means, such as skids 44 and 46 or rails, disposed on the barge.

The skids 24 and 26 are located at at least two discrete points along the length of the tower but are preferably disposed at three such points as illustrated in FIG. 2. The skid assume a generally rectangular configuration and are dimensioned so that the tower 10 is properly supported when the skids of the tower are in contact with the skids 44 and 46 of the barge (see FIG. 6) and when in contact with only the pivotable skids 48 (see FIG. 8).

Figure 4:
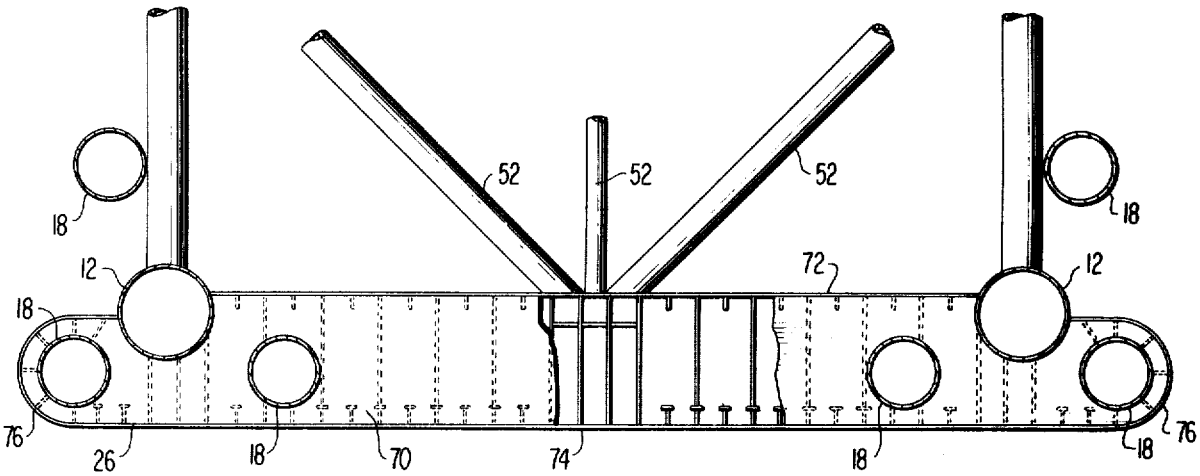
FIG. 4 illustrates a partial, transverse sectional view taken along the lines 4—4 of FIG. 2.
Figure 5:
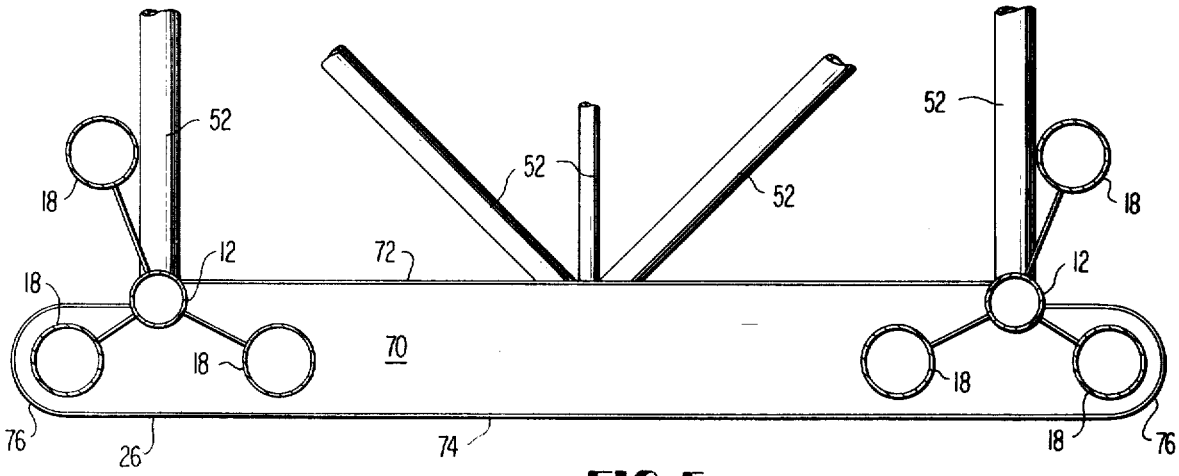
FIG. 5 illustrates a partial transverse sectional view taken along the lines 5—5 of FIG. 2.

As illustrated in FIGS. 3, 4, and 5, the skids preferably assume two, basic, different configurations. The differences in the configurations are dependent upon the size of the legs and the general configuration of the tower. FIG. 3 illustrates the topmost skid 24, while FIGS. 4 and 5 illustrate the middle and lowermost skids, respectively.

As illustrated in FIG. 3, the topmost skid 24 is characterized by generally planar sides 54 and a scuptured inboard side 56 configured for relatively close connection to the tower. The skid 24 also includes a generally planar outboard side 58 which curves toward the inboard, sculptured side of the skid at arcuate ends 60 thereof. The skid is hollow and is suitably internally reinforced. Preferably, flanged webs 62 and splayed webs 64 are employed. The skid 24 is interconnected with the tower through the leg and cross braces 12 and 52 respectively, by means of suitable brackets 66 and 68.

The middle and lowermost skids 26 are preferably essentially identical. These skids include planar sides 70 and a planar inboard side 72 extending between the legs 12. These skids further include a planar outboard side 74 which extends arcuately around arcuate ends 76 of the skid to connect with the legs 12. The skids 26 are suitably internally reinforced in a manner preferably similar to that employed in reinforcing the skid 24 illustrated in FIG. 3. As can be readily appreciated from FIGS. 4 and 5, the skids 26 are integrally connected with the legs 12 of one side of the tower.

A number of piling jackets through which piles are driven to anchor the tower are illustrated in FIGS. 4 and 5. These piling jackets are suitably connected with adjacent legs 12 and the skids 26 may fully surround one or more of these piling jackets. The skids 26 are also connected to the cross braces 52 forming a part of the bracing lattice 14 of the tower, and thus are incorporated as a part of this bracing lattice.

The tower and skids described to this point may be ballasted as desired. In this context, a quaternary of bouyant, generally columnar tanks 28 may be connected to upper portion of the tower so that the longitudinal axes thereof are generally parallel to the longitudinal axis of the tower. These buoyancy tanks are illustrated in FIGS. 6, 9, 10, and 11 and are shown in transverse section in FIG. 3. As FIG. 3 suggests, one bouyancy tank of the quaternary is disposed in each interior corner of the tower where it is connected thereto by a suitable bracket 78. These bouyancy tanks function to arrest movement of the tower as it pivots downwardly in the body of water as illustrated in FIG. 10.

The tanks are progressively submerged as the tower rotates so that the bouyant forces exerted on the tanks increase to the point that movement of the tower is essentially stopped. Ultimately, the quaternary of tanks serves to suspend the tower in an upright posture similar to that illustrated in FIG. 11 but elevated somewhat above the floor of the body of water. The invention in this way affords a method and apparatus for transporting and erecting a tower in deep water in which the manipulation of the tower in the water is entirely independent of any auxiliary supportive structure floating on the surface.

A large part of the buoyant support provided the tower is exerted by the buoyancy tanks 28. Thus, it is not necessary to flood large external tanks which may be coextensive with the tower and thus the center of gravity of the tower shifts less and/or more predictably. As a result, movement of the tower can be more carefully controlled. Indeed, little shifting of the center of gravity should occur as the tower rotates from the posture illustrated in FIG. 9 to that illustrated in FIG. 11. The principal shifting should occur as the tanks 28 are ballasted to lower the tower to the floor of the body of water. In this phase of the manipulation of the tower, the center of gravity should move predictably upward.

The Barge

As well illustrated in FIGS. 6 through 8, the barge may be essentially rectangular and may be towed by a suitable auxiliary towing vessel 42 through a tether 40. The barge is preferably characterized by a stern 32, a bow 34, and starboard and port sides 36 and 38 respectively.

The barge carries suitable supporting means for supporting the tower 10 as it rests on the deck of the barge. These supporting means may be comprised of suitable rails or skids 44 and 46. Portions of the supporting means are rigidly and nonpivotably connected to the barge. However, other portions include pivotable skids 48 which may be employed to increase the degree of inclination of the supporting means as the tower is moved off the side of the barge as illustrated in FIG. 8. Preferably a plurality of the pivotable skids 48 is employed and the skids are connected to the barge, as illustrated in FIG. 3, in a manner affording pivoting movement about at least one generally horizontal axis adjacent the edge 50 of the side of the barge which is lowered.

As indicated in FIG. 3, each pivotable skid includes a planar surface 82 which engages the planar outboard side of the skids connected to the tower. The pivotable skids preferably taper downwardly toward a fulcrum 84 pivotally mounted adjacent the edge 50 of the side of the barge. Because of the fixed relation between the edge of the barge and the pivotable skids, the location of the area of contact between the barge and tower can be controlled. The skids thus prevent any uncontrolled point loads from being applied to the barge. As illustrated, the pivotable skids overhang the edge of the barge considerably.

The pivotable skids remain in the posture illutrated in FIG. 3 until either the lateral center of gravity of the tower passes beyond the edge of the barge and the fulcrum of the pivotable skid or significant portions of the tower enter the water. The pivotable skids can pivot at this point under the weight of the tower or in response to the buoyancy of the tower to afford a relatively gentle movement of the tower into the water with minimal reactive movement of the barge (see FIG. 8). It should thus be emphasized that the supporting means, i.e., the skids connected to the barge, involve two discrete portions. One is fixed rigidly and nonpivotally to the barge. The other is pivotally connected thereto adjacent the edge of the barge. It can be readily appreciated at this point that the gentle entry of the tower assists in maintaining the tower in a stable posture. Additionally, because the area of contact between the tower and barge is reduced, less resistance is offered to the movement of the tower during launching.

Suitable rotating means are employed to statically incline the skids of the barge relative to the surface of the surrounding body of water. This rotating means is preferably comprised of successive ballasting chambers 86 individually extending in a manner generally parallel to the edge 50 (see FIG. 3) of the barge but serially extending transversely thereto. These successive ballasting chambers may be compartmentalized along the length thereof for increased stability as the chambers are ballasted. In other words, the chambers can be compartmentalized in order to keep the bulk of the ballasting material from flowing into one area of a chamber.

The successive ballasting chambers are ballasted by suitable ballasting means 88 operably associated with the barge. The ballasting means functions to ballast the successive ballasting chambers to progressively decreasing extents in a direction away from the edge 50 of the barge. In other words, the ballasting chamber adjacent the edge 50 is ballasted the most, while the farthest from the edge is ballasted the least. This particular mode of ballasting is illustrated schematically in FIG. 8. This progressive ballasting induces the rotation of the barge about a longitudinal axis, as illustrated in FIG. 8, and in lowering one side of the barge affords a ramp or incline down which the tower may move.

The successive ballasting chambers may also constitute lowering means for lowering the skids relative to the surface of the body of water. If the ballasting chambers are to perform this function, each should be ballasted equally to vertically lower the barge relative to the surface of the body of water. Lowering the barge and tower in this manner decreases the potential energy of the tower and should render the entry of the tower into the water more gentle. It should be emphasized at this point that the successive buoyancy chambers are such that even if they are initially equally ballasted to lower the tower relative to the surface of the body of water, the chambers can nonetheless be progressively ballasted to cause the barge to rotate as illustrated in FIG. 8. It should also be emphasized that the progressive ballasting of the chambers obviates the need for any ramp or other similar extraneous structure which might otherwise be required as a part of the barge.

While the tower and barge are in transit from a construction area to a desired offshore location, the tower is safely secured to the barge. The tower is only released from connection with the barge when the desired offshore location is reached and it is desired to launch the tower into the water. The barge is rotated and the tower must move down the incline formed by the skids or rails of the rotated barge. Suitable translating means 51 are provided to serve this function. The translating means may be comprised of any suitable means for exerting lateral forces on the tower sufficient to effect movement of the tower down the incline. Two different approaches to the movement of the barge down the incline can be employed. First, the translating means may be such that it is employed only to initiate movement of the tower. Thereafter, continued movement of the tower down the incline is afforded by the force of gravity. In this case, the skids of the supporting means must be inclined to a degree sufficient to ensure continued movement of the tower. Alternatively, the translating means may take the form of a jack or winch which exerts continuous lateral forces on the tower to move the tower down the incline and into the water. It should be emphasized that in either case, once the tower enters the water, the tower and barge are entirely independent of one another. There is no potential for the interference of any buoyancy tanks with drilling operations to be conducted later.

The Method of Transporting and Erecting the Offshore Tower

The invention affords a method of transporting and erecting an offshore tower which is quite advantageous relative to methods employed in the prior art. The method of the invention entails a number of operations illustrated sequentially in a general manner in FIGS. 6 through 11.

Initially, the tower 10 is supported on a barge 30 as illustrated in FIG. 6. Normally the barge is first located at a suitable graving dock and is complete with skids or rails, ballasting chambers, and other equipment discussed in the preceding. Once the barge is located in the graving dock, the tower can be constructed directly thereon, in its completed form including the skids and buoyancy tanks discussed earlier.

Next, as illustrated in FIG. 5 and 7, the tower and barge are together floated to a desired offshore location. This is accomplished by first opening the graving docks to flood the area and lift the tower and barge into a floating condition. Thereafter the combined tower and barge may be towed to the desired offshore location by means of an auxiliary towing vessel 42 connected to the barge 30 through a tether 40.

Once the desired offshore location is reached, the barge is rotated essentially about the longitudinal axis thereof, as illustrated in FIG. 8, to lower one side and statically, laterally incline the surfaces, i.e., the skids upon which the tower rests relative to the surface of the surrounding body of water transversely of the longitudinal axis. This rotation of the barge is accomplished by selectively ballasting the barge to reduce the buoyancy of discrete portions thereof as described earlier. These discrete portions include the successive buoyancy chambers 86. These buoyancy chambers may be ballasted in any desired manner but perhaps most desirably are ballasted with seawater pumped into the interiors of the chambers. It may also be desirable at this point to ballast the barge to raise the mean water line thereof and move the surfaces upon which the tower rests nearer the susrface of the surrounding water. These functions, i.e., the selective ballasting and the ballasting of the barge to raise the mean water line are not incompatible and may be performed concurrently so as to both incline the surfaces of the barge supporting the tower and also lower these surfaces. FIG. 8 illustrates both functions. The situation in which the tanks are ballasted to both incline and to lower the surfaces of the barge is shown by the indication of the water line 22 in phantom in FIG. 8.

Once the barge is statically inclined, the tower is translated down the incline of these surfaces, off the lowered side of the barge, and into the water free of the barge. As the lateral center of gravity of the tower passes beyond the edge 50 of the barge, the degree of inclination of the surfaces upon which the tower rests may be increased. Alternatively, if the tower has already begun entering the water, the inclination may be decreased. The degree of inclination is altered at this point by rotating the skids 48 overhanging the lowered edge of the barge and pivotable about at least one horizontal axis parallel thereto.

The mode of launching the tower presented in the foregoing affords a number of useful advantages. First, because the barge is itself inclined and perhaps lower in the water as well, there occurs no violent movement of the barge as the tower slips into the water. Furthermore, the mode of entry of the tower into the water described in the foregoing maintains better control over the movement of the tower. One corner of the tower simply slips into the water and before the tower has an opportunity to sink further, the adjacent corner slips laterally off the overhanging pivotable skids 48. The tower thereafter momentarily assumes the posture illustrated in FIG. 9. Additionally, because there is only fairly limited contact between the tower and barge, less resistance is offered to the launching of the tower.

The tower can be translated down the incline formed by the rotated barge in at least two different ways. First, the barge may be rotated to statically incline the surfaces thereof to such a degree as to cause the force of gravity to move the tower down the inclined surfaces and into the surrounding once the movement of the tower in that direction is initiated. Once the barge is inclined to this extent, lateral forces of a magnitude sufficient to initiate movement of the tower may be exerted on the tower down the incline. Alternatively, continuous lateral forces may be exerted on the tower to move the tower down the inclined surfaces into the water.

It should be readily apparent at this point that once the launching of the buoyant structure is initiated, the tower in effect sheds the buoyant structure almost immediately. The barge in no way accompanies the tower into the intended upright condition and is entirely independent of the tower in a structural sense. Thus the tower is not subject to buffeting as it is moved into an upright posture and is not buffeted by winds and heavy seas once erected to the extent it would, should the barge or any portion thereof remain attached thereto. The barge is also entirely reusable. No portion of the barge is at all incorporated in the structure of the tower.

Once the tower has been launched from the barge, the intended lower portion of the tower is submerged to turn the tower upright in the body of water as illustrated in FIG. 10. This submerging of the tower can be accomplished in either of two ways. The intended lower portion of the tower can be immediately submerged as a consequence of preexisting negative buoyancy. Alternatively the tower can be ballasted once it is launched to submerge the intended lower portion of the tower. In either case the tower simply pivots about a generally horizontal axis and moves toward an upright posture.

As the tower begins approaching a vertical posture, the rotation of the tower is arrested by the progressive submerging of the buoyancy tanks 28 as illustrated in FIG. 10. As indicated earlier, these tanks are of a generally columnar character and are oriented so that the longitudinal axes thereof are generally parallel to the longitudinal axis of the tower. Consequently, as the tower rotates about a generally horizontal axis, the buoyancy tanks disposed in the laterally upper corners of the tower are submerged to increasing extents and the resulting buoyancy forces act to resist continued rotation of the tower. Ultimately, when the tower reaches a generally upright posture, the tower is suspended by a quaternary of columnar buoyancy tanks.

When the tower reaches the generally upright, suspended condition discussed in the preceding paragraph, the base of the tower can be located at a desired point on the floor of the body of water, This phase of the operation is perhaps best illustrated in FIG. 11. The operation of locating the base of the tower entails restraining the movement of the tower away from the desired location. This can be accomplished through the use of a number of suitable mooring lines 53, each appropriately connected at one end to the tower and at the other to a work barge floating nearby or other suitable means. Once the tower is placed under restraint by the mooring lines, the buoyancy of the tower itself and/or the quaternary of generally columnar tanks can be reduced to lower the tower to the desired location on the floor of the body of water. At this point, erection of the tower is essentially complete. The uppermost skid 24 of the tower can be removed if desired for later use, as can the columnar buoyancy tanks 28. Concurrently, or perhaps prior to the removal of these structural elements, the tower can be anchored to the floor of the body of water by driving a number of pilings. Ultimately, the superstructure illustrated in FIG. 1 can be assembled atop the tower and the tower used for its intended purpose.

SUMMARY OF THE MAJOR ADVANTAGES OF THE INVENTION

It will be appreciated that in providing a novel method and apparatus for transporting and erecting an offshore tower, upright on the floor of a body of water, certain significant advantages are obtained.

A major advantage of the invention resides in the fact that the buoyant support employed to carry or manipulate the tower is of such a character that it undergoes little or no violent movement upon disconnection from the tower.

Another advantage of the invention accrues since the buoyant structure employed to transport the tower can be shed upon reaching the desired offshore location to reduce buffeting of the tower and possible impacting of the structures together.

Still another advantage of the invention is that afforded by the capability of the buoyant structure to be readily retrieved and reused to convey other offshore towers to different locations.

Yet still another advantage of the invention stems from the fact that upon being launched, the offshore tower can be turned upright and placed on the floor of the body of water with either only a minimal or only a predictable shifting in the location of the center of gravity thereof so that better control can be maintained over the placement of the tower.

A further advantage of the invention is afforded in the erection of the tower since the mode of entry of the tower into the water is such that the tendency of the tower toward uncontrolled movement can be maintained within sufficiently close tolerances as to ensure safe abd reliable placement of the tower on the floor of the body of water.

A still further advantage of the invention accrues in the erection of the tower because the buoyant support afforded the tower during transportation to the desired offshore location is removed relatively rapidly so as to diminish the vulnerability of the tower to uncontrolled movement.

Yet still a further advantage of the invention resides in the fact that the placement of the tower on the floor of the body of water is independent of structural elements floating on the surface and is amenable to the convenient placement of large towers in deep water.

Yet another advantage of the invention stems from the fact that extraneous structural elements associated with the buoyant structure transporting the tower are obviated.

Yet still another advantage of the invention is derived from the fact that the resistance offered by the buoyant support to the launching of the tower is minimized.

In describing the invention, reference has been made to a preferred embodiment. However, those skilled in the art and familiar with the disclosure of the invention may recognize additions, deletions, substitutions, or other modifications which would fall within the purview of the invention as defined in the claims.

What is claimed is:

1. A method of transporting and erecting an offshore tower, upright on the floor of a body of water, comprising the steps of:

supporting the tower on a barge with one lateral edge thereof being supported on pivotable skid means located along the overhanging one side of said barge and having a pivot axis extending longitudinally of said barge and tower and another lateral edge thereof being supported on fixed skid means;

floating the tower and the barge to a desired offshore location;

rotating the barge about a longitudinal axis to lower said one side thereof and, laterally incline said pivotable skid means and fixed skid means of the barge upon which the tower rests relative to the surface of the surrounding body of water transversely of the longitudinal axis;

translating the tower laterally of said barge and slidably across said laterally inclined pivotable skid means and away from said fixed skid means;

pivoting said tower about the pivot axis of said pivotable skid means to effect entry of said tower into said water free of said barge with said tower undergoing lateral sliding and downward pivotal movement relative to said barge across said overhanging pivotable skid means;

submerging the intended lower portion of the tower to turn the tower upright in the body of water; and locating the base of the tower at a desired location on the floor of the body of water.

2. The method of transporting and erecting an offshore tower as defined in claim 1, wherein said step of submerging the intended lower portion of the tower comprises the steps of:

submerging the intended lower portion of the tower by pivoting the tower about a generally horizontal axis; and arresting the rotation of the tower as the tower approaches the intended vertical orientation by progressively submerging buoyancy tanks of a generally columnar character oriented so that the longitudinal axes thereof are generally parallel to the longitudinal axis of the tower and located in the intended upper end of the tower.

3. The method of transporting and erecting an offshore tower as defined in claim 2, wherein said step of pivoting the tower about a generally horizontal axis comprises the step of:

supporting the tower principally through the buoyancy of the columnar buoyancy tanks while essentially immediately submerging the intended lower end of the tower as a consequence of preexisting negative buoyancy thereof.

4. The method of transporting and erecting an offshore tower as defined in claim 2, wherein said step of pivoting the tower about a generally horizontal axis comprises the step of:

ballasting and thus submerging the intended lower end of the tower while concurrently maintaining the buoyancy of the columnar buoyancy tanks.

5. The method of transporting and erecting an offshore tower as defined in claim 2, wherein said step of submerging the intended lower portion of the tower further comprises the step of:

suspending the tower by a quaternary of the bouyant, generally columnar tanks once the tower reaches a generally upright condition.

6. The methods of transporting and erecting an offshore tower as defined in claim 5, wherein said step of locating the base of the tower at a desired location on the floor of the body of water comprises the steps of:

restraining movement of the tower away from a desired location on the floor of the body of water through a plurality of mooring lines; and reducing the buoyancy of the quaternary of generally columnar tanks to lower the tower to the desired location on the floor of the body of water.

7. Apparatus for transporting and erecting an offshore tower on the floor of a body of water comprising:

a barge for buoyantly supporting the tower as the tower is conveyed to a desired offshore location;

supporting means disposed on said barge for supporting the tower thereon;

said supporting means including pivotable skid means supporting one lateral edge of said tower and located along the overhanging one side of said barge and having a pivot axis extending longitudinally of said barge and tower, and fixed skid means supporting another lateral edge of said tower;

sliding means connected to the tower for slidingly interconnecting the tower and said supporting means;

rotating means operably associated with said barge for rotating said barge about a longitudinal axis thereof to lower a side thereof to laterally incline said pivotable skid means and fixed skid means and said sliding means relative to the surface of the surrounding body of water when said barge and the tower reach the desired offshore location; and said tower being operable to move down the incline of said supporting means off said lowered side of said barge and into the surrounding water, the tower and said sliding means moving in sliding relation along said suporting means; and said tower, during said movement down said incline, translating laterally of said barge and slidably across said laterally inclined pivotable skid means and fixed skid means, and pivoting about the pivot axis of said pivotable skid means to effect entry of said tower into said water free of said barge with said tower undergoing lateral sliding and downward pivotable movement relative to said barge across said overhanging pivotable skid means.

8. The apparatus for transporting an erecting an offshore tower on the floor of a body of water as defined in claim 7, further comprising:

a quaternary of buoyant, generally columnar tanks connected to upper portions of the interior of the tower with the longitudinal axes thereof generally parallel to the longitudinal axis of the tower, the tanks being progressively submerged as the tower is turned upright in the body of water and operable to arrest rotation of said tower as it approaches a vertical orientation.

9. The apparatus for transporting and erecting an offshore tower on the floor of a body of water as defined in claim 8 wherein:

said quaternary of tanks suspends the tower in an upright posture and wherein said tanks are ballastable to lower the tower to the floor of the body of water.

* * * * *